US005320040A

United States Patent [19]

Simeth

[11] Patent Number: 5,320,040

[45] Date of Patent: Jun. 14, 1994

[54] ROTARY SHEET-PRINTING PRESS HAVING A REGISTER BAR

[75] Inventor: Claus D. Simeth, Geisenheim-Johannisberg, Fed. Rep. of Germany

[73] Assignee: MAN Miller Druckmaschinen GmbH, Geisenheim, Fed. Rep. of Germany

[21] Appl. No.: 846,232

[22] Filed: Mar. 6, 1992

[30] Foreign Application Priority Data

Mar. 6, 1991 [DE] Fed. Rep. of Germany ..... 4107080

[51] Int. Cl.[5] ..... B41F 13/24

[52] U.S. Cl. ..... 101/232; 271/245; 271/255

[58] Field of Search ..... 101/231, 232, 233, 239, 101/242, 485, 248; 271/245, 246, 253, 255

[56] References Cited

U.S. PATENT DOCUMENTS 4,051,779 10/1977 Zaagman ..... 101/242
4,177,730 12/1979 Schriber et al. ..... 101/485
4,473,222 9/1984 Simmons et al. ..... 271/255
5,117,365 5/1992 Jeschke et al. ..... 101/248

FOREIGN PATENT DOCUMENTS 0241773 10/1987 European Pat. Off. .
206888 2/1984 Fed. Rep. of Germany .
3827944 3/1989 Fed. Rep. of Germany .

*Primary Examiner*—Edgar S. Burr
*Assistant Examiner*—Ren Yan
*Attorney, Agent, or Firm*—Spencer, Frank & Schneider

[57] ABSTRACT

A rotary sheet-printing press includes a register bar; a plurality of front lay marks mounted on the register bar in a series extending perpendicularly to a sheet-feeding direction; a plurality of setting motors, each connected to a separate front lay mark for shifting each front lay mark parallel to the sheet-feeding direction; a control panel; manually operable controls mounted on the control panel in a field of vision of the front lay marks and connected to the setting motors for energizing the setting motors of a desired number of arbitrarily selected front lay marks and for adjusting the selected front lay marks parallel to the sheet-feeding direction; and a visual indicator mounted on the control panel and operatively connected to the front lay marks for displaying actual positions thereof.

7 Claims, 1 Drawing Sheet

ROTARY SHEET-PRINTING PRESS HAVING A REGISTER BAR

CROSS REFERENCE TO RELATED APPLICATION

This application claims the priority of German Application No. P 41 07 080.1 filed Mar. 6, 1991, which is incorporated herein by reference.

BACKGROUND OF THE INVENTION

This invention relates to a rotary sheet-printing press which includes a register bar provided with a plurality of front lay marks arranged in a series transverse to the direction of advance of the sheets to be printed. The front lay marks serve the purpose of aligning the leading edge of the sheet to be printed and are individually adjustable parallel to the direction of sheet advance.

Due to errors during the cutting of the sheets, the leading sheet edges are not always straight and/or are not always perpendicular to the lateral sheet edges.

In order to compensate for such error which may lead to faulty alignments in the printing press, it is known to align the front lay marks individually, corresponding to the course of the leading edge of the sheet. Such an alignment has been conventionally performed manually, while using an appropriate tool, such as a wrench. Such a procedure, however, has several disadvantages: it is time-consuming, it can be performed only while the press is at a standstill and, in particular, upon a displacement (adjustment) of any particular front lay mark, the operating person loses visual contact with that front lay mark to concentrate on the manual adjustment. As a result, it is not possible to make a direct verification whether the adjustment was sufficient or excessive. Also, it may occasionally occur that the wrong front lay mark is being adjusted.

SUMMARY OF THE INVENTION

It is an object of the invention to provide an improved rotary sheet-printing press from which the above-discussed disadvantages are eliminated by substantially simplifying the required adjustments of the front lay marks.

This object and others to become apparent as the specification progresses, are accomplished by the invention, according to which, briefly stated, the rotary sheet-printing press includes a register bar; a plurality of front lay marks mounted on the register bar in a series extending perpendicularly to a sheet-feeding direction; a plurality of setting motors, each connected to a separate front lay mark for shifting each front lay mark parallel to the sheet-feeding direction; a control panel; manually operable controls mounted on the control panel in a field of vision of the front lay marks and connected to the setting motors for energizing the setting motors of a desired number of arbitrarily selected front lay marks and for adjusting the selected front lay marks parallel to the sheet-feeding direction; and a visual indicator mounted on the control panel and operatively connected to the front lay marks for displaying actual positions thereof.

Thus, upon determination that one or more front lay marks must be adjusted because during the operation of the press it was observed that the leading edges of the sheets are not perpendicular to the direction of sheet advance, the operating person needs only to actuate the appropriate keys of the control panel, whereupon the respective front lay mark or several front lay marks are displaced in accordance with the inputted commands. Such command is given while the operating person has a visual contact with the front lay marks so that the operating person—during operation of the printing press—may directly and immediately verify whether the extent of the adjustment was proper.

The term "visual contact", as related to the invention, means that the operating person is able to perform the front lay mark adjusting commands while simultaneously visually observing all the front lay marks. Thus, the arrangement according to the invention provides a direct and immediate association between the extent of displacements and the control unit associated with such displacements, without resorting to the circumstantial solution of the prior art where the operating person, to effect a displacement of the front lay marks, had to move to another location losing, at the same time, a visual contact with the front lay marks to be adjusted.

To ensure that the operating person is capable of effecting displacement of the front lay marks from either side of the printing press, according to a further feature of the invention, the manually operable controls on the control panel are duplicated and are arranged adjacent either side of the printing press.

DESCRIPTION OF THE PREFERRED EMBODIMENT

Figure 1:
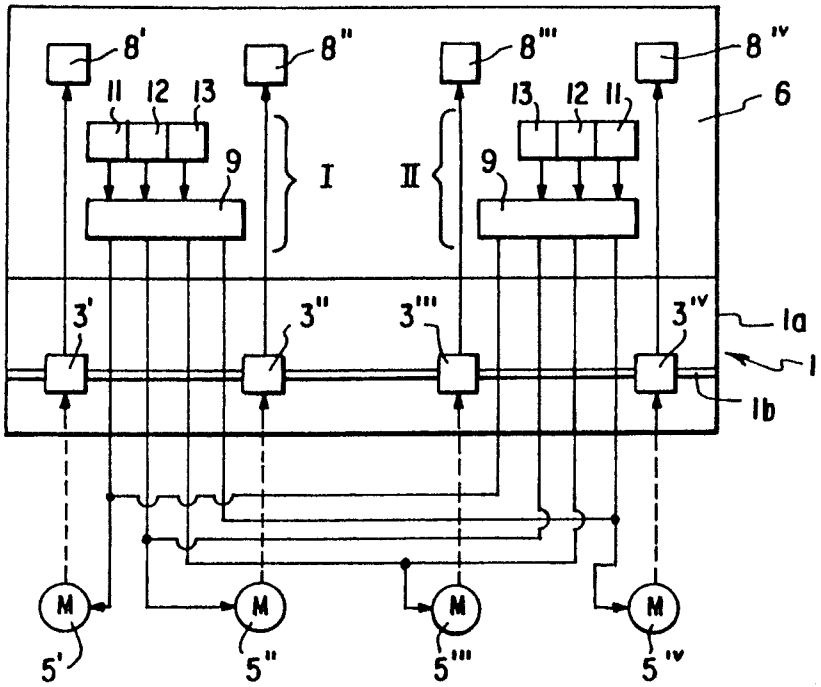
FIG. 1 is a schematic front elevational view of a sheet-printing press and a control panel mounted thereon, with diagramatically shown control circuits.
Figure 2:
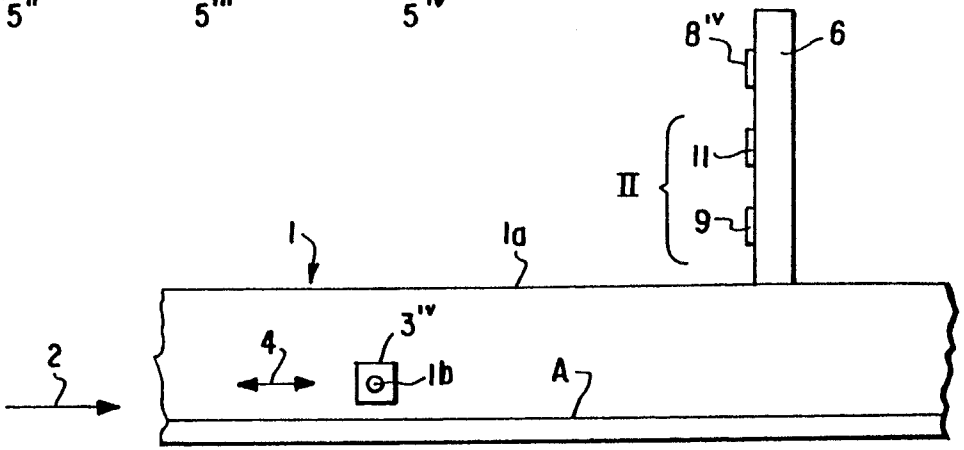
FIG. 2 is a schematic side elevational view of the sheet-printing press and control panel.

Turning to FIGS. 1 and 2, a rotary sheet-printing press generally designated at 1 has a machine frame 1*a* and a register bar 1*b* supporting a plurality of front lay marks $3^{I}$, $3^{II}$, $3^{III}$ and $3^{IV}$. For the sake of simplicity of illustration, only four front lay marks are shown. The sheets to be printed are advanced on a sheet-support A towards the register bar 1*b* for introduction into the printing press 1 in the direction of the arrow 2. Each front lay mark $3^{I}$–$3^{IV}$ is individually adjustable on the register bar 1*b* in the direction of the double-headed arrow 4, that is, each front lay mark may be displaced in or against the sheet feeding direction 2.

According to the invention, the displacement of the front lay marks is effected by individual setting motors $5^{I}$, $5^{II}$, $5^{III}$ and $5^{IV}$, mechanically connected with the associated respective front lay marks $3^{I}$–$3^{IV}$. For controlling the position of each front lay mark $3^{I}$–$3^{IV}$, a control panel 6 is provided transversely on the printing press 1, downstream of the register bar 1*b*, as viewed in the sheet-feeding direction 2. The control panel 6 may be disposed, for example, at eye-level of an operating person standing beside the printing press 1.

The control panel 6 has indicators $8^{I}$, $8^{II}$, $8^{III}$ and $8^{IV}$ connected to the respective front lay mark $3^{I}$–$3^{IV}$ to visually indicate the exact position thereof. Each indicator may, for example, express the position of the associated front lay mark in one-hundredths of a millimeter from a predetermined zero (center) position.

On the control panel 6 there are mounted identical, manually operable control units I and II situated adjacent the one and other side of the printing press 1. Each control unit I and II has a selector switch 9 for selecting a desired front lay mark or marks $3^{I}$–$3^{IV}$ to be shifted. The selector 9 may consist, for example, of a plurality of keys, each associated with a separate motor $5^{I}$–$5^{IV}$ for the selection of a single front lay mark $3^{I}$–$3^{IV}$ or a plurality of front lay marks $3^{I}$–$3^{IV}$ to be operated simultaneously. This arrangement makes also feasible a simultaneous actuation of all the front lay marks. The selector 9 is connected with a control input of each of the setting motors $5^{I}$–$5^{IV}$. Each control unit I and II furthermore includes a "minus" key 11, a "plus" key 12 as well as a "zero" key 13. The minus key 11 is, for example, associated with a shift of the front lay marks $3^{I}$–$3^{IV}$ in the feed direction 2, the plus key 12 is associated with the shifting motion of the front lay marks $3^{I}$–$3^{IV}$ in the direction against the feed direction 2, whereas the key 13 is associated with the predetermined zero (center) position of the front lay marks relative to the register bar 1*a*. The keys 11, 12 and 13 are connected to the selector 9. The control units I and II are in the field of vision of the front lay marks $3^{I}$–$3^{IV}$, so that while observing and/or manipulating the keys of the control unit I or those of the control unit II as will be described later, the operating person may, at the same time, observe the front lay marks $3^{I}$–$3^{IV}$ themselves. Further, the indicators $8^{I}$–$8^{IV}$ are in the field of vision of the control units I and II.

In the description which follows, the operation of the above-described control will be set forth.

As the operating person determines that a misalignment between the leading sheet edge and any of the front lay marks $3^{I}$–$3^{IV}$ has occurred, he selects the front lay mark or marks which may correct the error, by depressing the appropriate selector key or keys of the selector 9. Such a selection establishes the operating connection between the keys 11, 12, 13 on the one hand and the selected setting motors $5^{I}$–$5^{IV}$, on the other hand. Thereafter, by depressing one of the keys 11 or 12, the selected front lay mark (or front lay marks) $3^{I}$–$3^{IV}$ is shifted in the one or the other direction as indicated by the double-headed arrow 4. Such a displacement and the resulting effect can be observed by the operating person at the time he performs the adjustment and correction, that is, while the printing press is operating. The indicators $8^{I}$–$8^{IV}$ show the actual displacement of the associated front lay marks $3^{I}$–$3^{III}$ and may also serve for recording the experimentally found optimal position of the front lay marks.

While the presence of duplicate control units I and II provides the convenience of working with the control panel 6 from either side of the printing press 1, it is to be understood that it is within the scope of the invention to provide but a single set of keys 9, 11, 12 and 13.

It will be further understood that the above description of the present invention is susceptible to various modifications, changes and adaptations, and the same are intended to be comprehended within the meaning and range of equivalents of the appended claims.

What is claimed is:

1. A rotary sheet-printing press, comprising (a) a register bar;

(b) a plurality of front lay marks mounted on said register bar in a series extending perpendicularly to a sheet-feeding direction;

(c) a plurality of setting motors, each connected to a separate said front lay mark for shifting each said front lay mark parallel to said sheet-feeding direction;

(d) a control panel;

(e) manually operable control means being in a field of vision of said front lay marks and being mounted on said control panel and connected to said setting motors for energizing the setting motors of a desired number of arbitrarily selected front lay marks and for adjusting the selected front lay marks parallel to said sheet-feeding direction; said manually operable control means comprising a selector for arbitrarily selecting a desired number of front lay marks, control key means of arbitrarily adjusting the selected front lay marks in or against said sheet-feeding direction and zero-key means for placing the selected front lay marks into a predetermined zero position; and (f) visual indicator means mounted on said control panel and operatively connected to said front lay marks for displaying actual positions thereof.

2. A rotary sheet-printing press as defined in claim 1, wherein said visual indicator means is situated in a field of vision of said manually operable control means.

3. A rotary sheet-printing press as defined in claim 1, further comprising a machine frame; said control panel being mounted on said machine frame downstream of said register bar as viewed in said sheet-feeding direction.

4. A rotary sheet-printing press as defined in claim 3, further comprising opposite longitudinal sides; said manually operable control means being located adjacent one of said longitudinal sides.

5. A rotary sheet-printing press having opposite longitudinal sides, comprising (a) a register bar;

(b) a plurality of front lay marks mounted on said register bar in a series extending perpendicularly to a sheet-feeding direction;

(c) a plurality of setting motors, each connected to a separate said front lay mark for shifting each said front lay mark parallel to said sheet-feeding direction;

(d) a control panel;

(e) two sets of manually operable control means mounted on said control panel and connected to said setting motors for energizing the setting motors of a desired number of arbitrarily selected front lay marks and for adjusting the selected front lay marks parallel to said sheet-feeding direction; the two sets being situated adjacent the one and the other longitudinal side, respectively and being in a field of vision of said front lay marks; each said manually operable control means comprising a selector for arbitrarily selecting a desired number of front lay marks, control key means for arbitrarily adjusting the selected front lay marks in or against said sheet-feeding direction and zero-key means for placing the selected front lay marks into a predetermined zero position; and (f) visual indicator means mounted on said control panel and operatively connected to said front lay marks for displaying actual positions thereof.

6. A rotary sheet-printing press as defined in claim 5, wherein said visual indicator means is situated in a field of vision of said two sets of manually operable control means.

7. A rotary sheet-printing press as defined in claim 5, further comprising a machine frame; said control panel being mounted on said machine frame downstream of said register bar as viewed in said sheet-feeding direction.

* * * * *